US007077111B2

(12) United States Patent
Robertson et al.

(10) Patent No.: US 7,077,111 B2
(45) Date of Patent: Jul. 18, 2006

(54) VARIABLE PURGE ORIFICE ASSEMBLY

(75) Inventors: William R. Robertson, Irondequoit, NY (US); Charles H. Covert, Manchester, NY (US); Gordon R. Paddock, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/869,342

(22) Filed: Jun. 16, 2004

(65) Prior Publication Data

US 2005/0279331 A1 Dec. 22, 2005

(51) Int. Cl.
*F02M 37/04* (2006.01)

(52) U.S. Cl. ..... 123/516; 123/458

(58) Field of Classification Search ..... 123/519, 123/520, 521, 518, 516, 458
See application file for complete search history.

(56) References Cited

U.S. PATENT DOCUMENTS 4,446,838 A 5/1984 Suzuki et al.
4,700,683 A * 10/1987 Uranishi et al. ..... 123/519
4,809,667 A * 3/1989 Uranishi et al. ..... 123/520
4,886,096 A 12/1989 Reddy
4,901,702 A * 2/1990 Beicht et al. ..... 123/520
4,944,276 A * 7/1990 House et al. ..... 123/520
4,951,637 A * 8/1990 Cook ..... 123/520
5,069,188 A * 12/1991 Cook ..... 123/520
5,239,858 A 8/1993 Rogers et al.
5,245,973 A 9/1993 Otsuka et al.
5,284,121 A * 2/1994 Abe et al. ..... 123/520
5,413,082 A * 5/1995 Cook et al. ..... 123/520
5,669,361 A 9/1997 Weissinger et al.
5,671,718 A 9/1997 Curran et al.
5,715,799 A 2/1998 Blomquist et al.
5,970,958 A * 10/1999 DeLand et al. ..... 123/520
6,050,245 A 4/2000 Cook et al.
6,067,967 A 5/2000 Kidokoro et al.
6,546,955 B1 4/2003 Burke
6,681,746 B1 * 1/2004 Cook et al. ..... 123/520

* cited by examiner

*Primary Examiner*—Carl S. Miller
(74) *Attorney, Agent, or Firm*—Jimmy L. Funke

(57) ABSTRACT

A variable purge orifice assembly for an evaporative emission system of a vehicle includes a housing for fluid connection to a vapor canister and a purge solenoid of the evaporative emission system. The housing has a purge orifice therein. The variable purge orifice assembly also includes a regulating device connected to the housing and for connection to an engine of the vehicle. The regulating device is actuated by manifold vacuum from the engine to vary flow of fuel vapor through the purge orifice from the vapor canister to the purge solenoid.

17 Claims, 3 Drawing Sheets

VARIABLE PURGE ORIFICE ASSEMBLY

TECHNICAL FIELD

The present invention relates generally to evaporative emission systems for vehicles and, more particularly, to a variable purge orifice assembly for an evaporative emission system of a vehicle.

BACKGROUND OF THE INVENTION

It is known to provide a fuel system for a vehicle having a fuel tank to hold fuel to be used by an engine of the vehicle. It is also known to provide an evaporative emission system for a fuel system of the vehicle to recover fuel vapor. Typically, the evaporative emission system includes a vapor canister remotely mounted such as in an engine compartment of the vehicle and operatively connected by separate external valves and lines to a fuel tank.

Typically, purge solenoid valves are operated between manifold vacuum and pressure of the evaporative emission system, which is approximately atmospheric pressure. However, this allows the highest purge flows at low engine airflows and the lowest purge flow at the highest engine airflows, which is undesired.

Therefore, it is desirable to provide a purge flow more proportional to engine airflow for an evaporative emission system of a vehicle. It is also desirable to provide a variable metering or purge orifice for purge flow in an evaporative emission system of a vehicle. It is further desirable to provide a variable metering or purge orifice that allows a flow rate of a purge solenoid to be increased without losing low flow resolution.

SUMMARY OF THE INVENTION

Accordingly, the present invention is a variable purge orifice assembly for an evaporative emission system of a vehicle. The variable purge orifice assembly includes a housing for fluid connection to a vapor canister and a purge solenoid of the evaporative emission system. The housing has a purge orifice therein. The variable purge orifice assembly also includes a regulating device connected to the housing and for connection to an engine of the vehicle. The regulating device is actuated by manifold vacuum from the engine to vary flow of fuel vapor through the purge orifice from the vapor canister to the purge solenoid.

One advantage of the present invention is that a variable purge orifice assembly is provided for an evaporative emission system of a vehicle. Another advantage of the present invention is that the variable purge orifice assembly incorporates a regulating device for metering purge flow serially with a pulsewidth modulated solenoid, which is optional. Yet another advantage of the present invention is that the variable purge orifice assembly achieves flow regulation by utilizing engine manifold vacuum to actuate the regulating device. Still another advantage of the present invention is that the variable purge orifice assembly maximizes the orifice at low manifold vacuum such that the solenoid flow is unrestricted. A further advantage of the present invention is that the variable purge orifice assembly minimizes the orifice at high vacuum manifold such that the solenoid flow is restricted, allowing the purge solenoid flow rate to be increased without losing low flow resolution.

Other features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
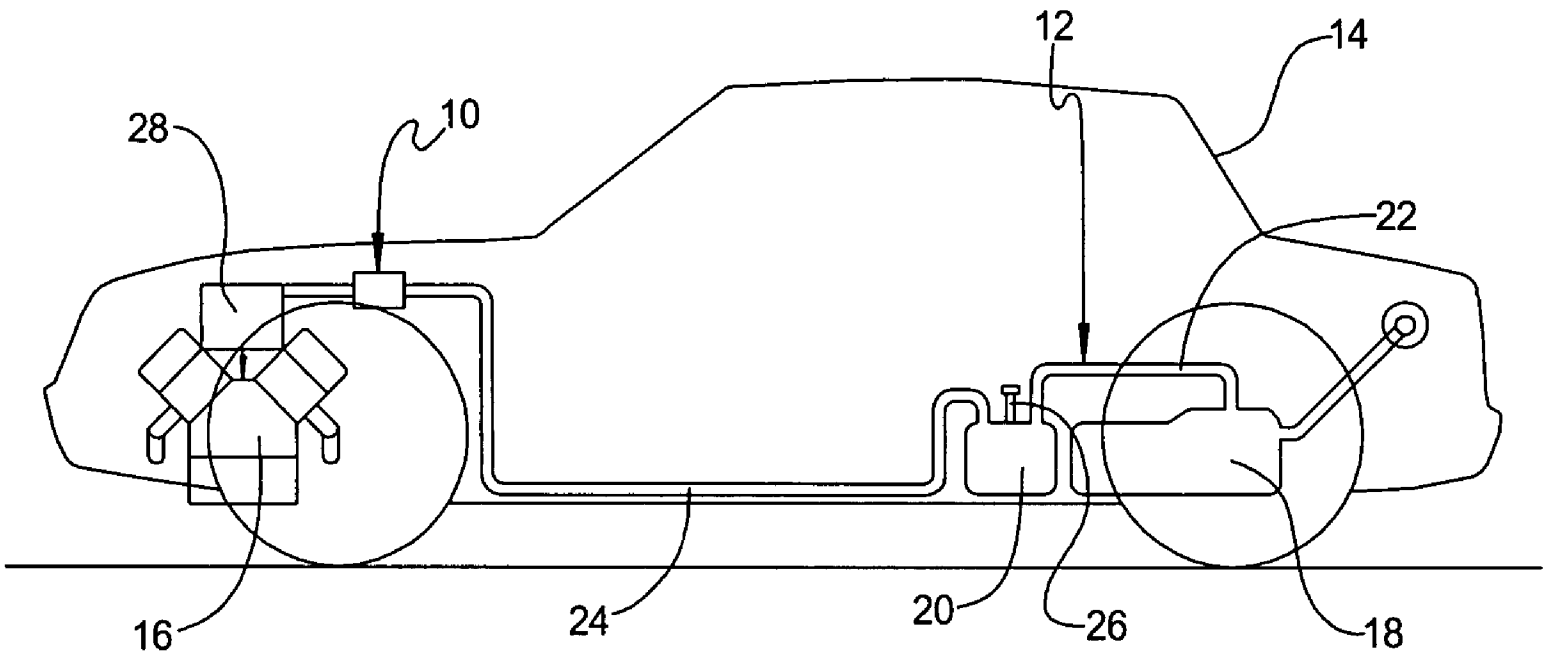
FIG. 1 is a fragmentary elevational view of a variable purge orifice assembly, according to the present invention, illustrated in operational relationship with an evaporative emission system for a vehicle.

Referring to the drawings and in particular FIG. 1, one embodiment of a variable purge orifice assembly 10, according to the present invention, is shown for an evaporative emission system, generally indicated at 12, for a vehicle 14. The vehicle 14 includes an engine 16 and a fuel tank 18 for supplying fuel to the engine 16. The vehicle 14 also includes the evaporative emission system 12 interconnecting the engine 16 and the fuel tank 18. It should be appreciated that the vehicle 14 is conventional and known in the art.

The evaporative emission system 12 includes a vapor canister 20 holding a canister bed (not shown) to adsorb hydrocarbon or fuel vapor while allowing air to pass to and from the fuel tank 18. The vapor canister 20 has a first tube 22 for communicating with the fuel tank 18, a second tube 24 communicating with and being purged by the engine 16 and a third tube 26 communicating with the outside environment. It should be appreciated that the vapor canister 20 is conventional and known in the art.

The evaporative emission system 12 also includes a purge solenoid 28 interconnecting the engine 16 and the vapor canister 20. The purge solenoid 28 is disposed along and fluidly communicates with the second tube 24. The purge solenoid 28 is connected to a source of power (not shown) such as an electronic control module (not shown). It should be appreciated that the purge solenoid 28 is conventional and known in the art.

The evaporative emission system 12 further includes the variable purge orifice assembly 10 interconnecting the purge solenoid 28 and the vapor canister 20. The variable purge orifice assembly 10 is disposed along and fluidly communicates with the second tube 24. It should be appreciated that, except for the variable purge orifice assembly 10, the evaporative emission system 12 is conventional and known in the art.

Figure 2:
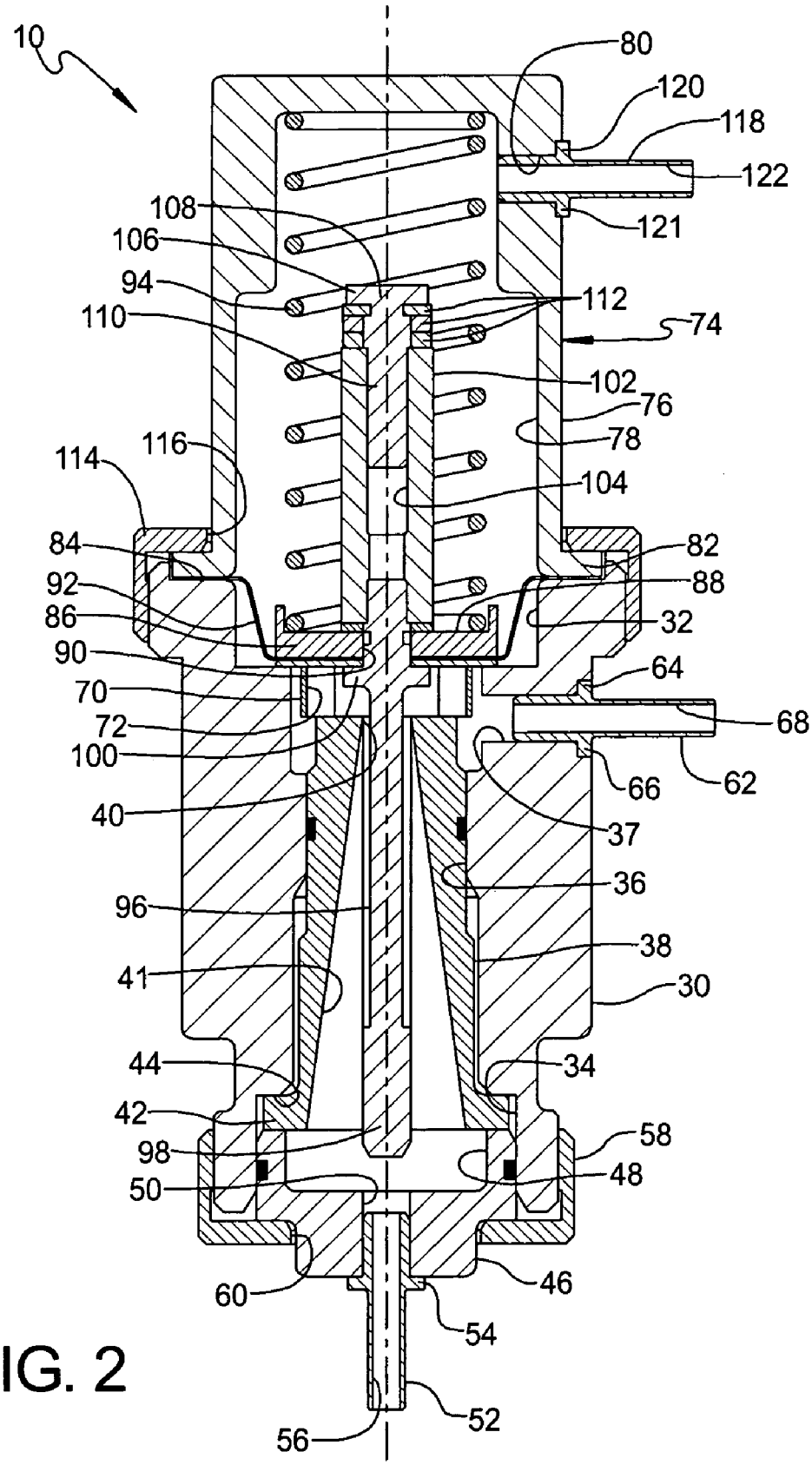
FIG. 2 is a fragmentary elevational view of the variable purge orifice assembly of FIG. 1 illustrating a low vacuum state.
Figure 3:
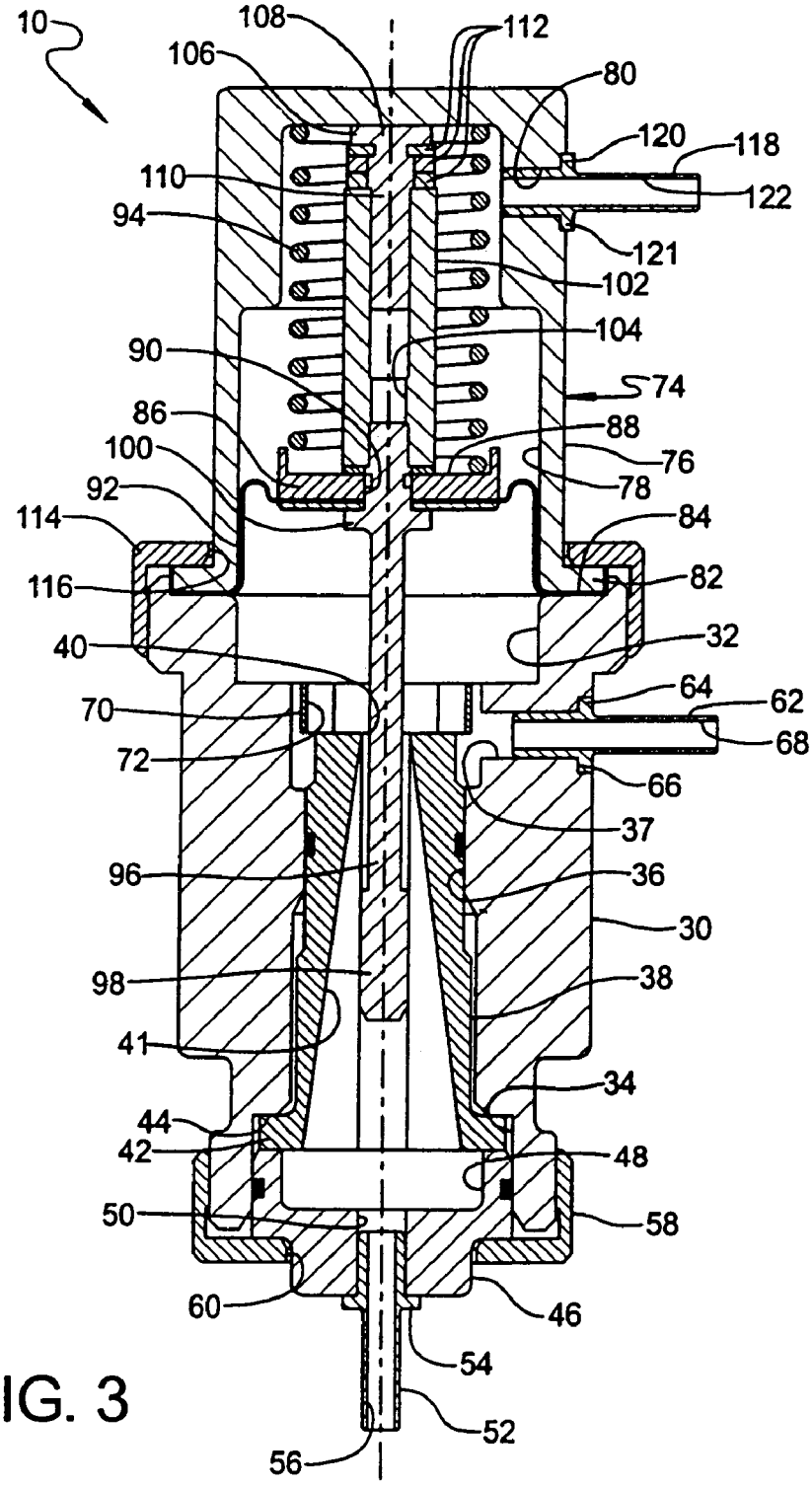
FIG. 3 is a fragmentary elevational view of the variable purge orifice assembly of FIG. 1 illustrating a high vacuum state.

Referring to FIGS. 2 and 3, the variable purge orifice assembly 10, according to the present invention, includes a body or housing 30. The housing 30 is generally cylindrical and circular in shape. The housing 30 has a first cavity 32 extending axially inward at one end. The housing 30 has a second cavity 34 extending axially inward at the other end. The housing 30 has a first passageway 36 extending axially and communicating with the first cavity 32 and second cavity 34. The housing 30 has a second passageway 37 extending radially therein and communicating with the first cavity 32. The housing 30 is made of a rigid material such as metal.

The variable purge orifice assembly 10 also includes an insert 38 disposed within the first passageway 36. The insert 38 is cylindrical and circular in shape. The insert 38 has a guide passageway 40 extending axially therethrough. The inset 38 also has a purge orifice such as a tapered slot 41 extending axially and radially outwardly from the guide passageway 40 from an inlet to an outlet thereof. The insert 38 has a flange 42 extending radially from a lower end thereof to engage a shoulder 44 of the housing 30 forming a portion of the second cavity 34. The insert 38 is made of a rigid material such as metal. It should be appreciated that the tapered slot 41 may be tailored to create an orifice area versus differential pressure curve that is desired.

The variable purge orifice assembly 10 includes an end member 46 partially disposed in the second cavity 34 of the housing 30. The end member 46 is generally cylindrical and circular in shape. The end member 46 has a cavity 48 extending axially inward at one end. The end member 46 has a passageway 50 extending axially from the other end and communicating with the cavity 48. The end member 46 is made of a rigid material such as metal.

The variable purge orifice assembly 10 also includes a connector 52 connected to the end member 46 for connection to the purge solenoid 28. The connector 52 is generally cylindrical and circular in shape. The connector 52 has a flange 54 extending radially outward. The connector 52 is partially disposed in the passageway 50 of the end member 46 such that the flange 54 abuts the end of the end member 46. The connector 52 has a passageway 56 extending axially therethrough. The connector 52 is made of a rigid material such as metal.

The variable purge orifice assembly 10 includes a cover 58 disposed over a portion of the end member 46 and the housing 30. The cover 58 is generally cylindrical and circular in shape. The cover 58 has an aperture 60 extending axially therethrough to allow a portion of the end member 46 to extend therethrough. The cover 58 is made of a rigid material such as metal. It should be appreciated that the cover 58 is secured to the housing 30 by a suitable mechanism such as press-fitting.

The variable purge orifice assembly 10 further includes a connector 62 connected to the housing 30 for connection to the second tube 24. The connector 62 is generally cylindrical and circular in shape. The connector 62 has a flange 64 extending radially outward. The connector 62 is partially disposed in the second passageway 37 of the housing 30 such that the flange 64 sits in a recess 66 of the housing 30. The connector 62 has a passageway 68 extending axially therethrough. The connector 62 is made of a rigid material such as metal.

The variable purge orifice assembly 10 may include a stop 70 disposed within the first cavity 32 and abutting the insert 38. The stop 70 is cylindrical and circular in shape. The stop 70 has an aperture 72 extending axially therethrough. The aperture 72 is generally circular in shape. The stop 70 is made of a rigid material such as metal. It should be appreciated that the stop 70 does not shut off or otherwise regulate flow, which is able to pass from the connector 62 to the connector 52 at all times. It should also be appreciated that the stop 70 is optional.

The variable purge orifice assembly 10 also includes a regulating device, generally indicated at 74, for metering purge flow serially through the purge orifice 40. The regulating device 74 includes a body or housing 76. The housing 76 is generally cylindrical and circular in shape. The housing 76 has a cavity 78 extending axially inward at one end. The housing 76 has a passageway 80 extending radially therein and communicating with the cavity 78. The housing 76 has a flange 82 extending radially from a lower end thereof to engage a shoulder 84 of the housing 30 forming a portion of the first cavity 32. The housing 76 is made of a rigid material such as metal.

The regulating device 74 also includes a movable piston 86 for opening and closing the aperture 72 of the valve seat 70. The piston 86 is generally cylindrical and circular in cross-sectional shape. The piston 86 has a cavity 88 extending axially inward from one end. The piston 86 has a passageway 90 extending axially inward from the other end and communicating with the cavity 88. The piston 86 is disposed in the cavity 78 of the housing 76. The piston 86 is made of a rigid material such as plastic.

The regulating device 74 includes a flexible membrane seal 92 disposed in the housing 76. The seal 92 is generally circular in shape. The seal 92 extends through the piston 86 and has an aperture aligned with the passageway 88 that is generally circular in shape. The seal 92 extends axially and radially from the piston 86 and has a portion disposed between the flange 82 of the housing 76 and the shoulder 84 of the housing 30. The seal 92 is made of a flexible material such as an elastomeric material or a flexible injection moldable polymer, preferably Viton, NBR, or trifluoroethylene (TFE).

The regulating device 74 further includes a spring 94 disposed in the cavity 78 of the housing 76. The spring 94 is of a coil type. The spring 94 extends axially and has one end disposed in the cavity 88 of the piston 86 and another end abutting the housing 76 at an axial end of the cavity 78. The spring 94 is made of a spring material such as metal, preferably ferrous or stainless steel. It should be appreciated that the spring 94 forms a spring biasing mechanism for the piston 86.

The regulating device 74 includes a guide member or pintle 96 connected to the piston 86 for guiding movement of the piston 86. The pintle 96 is generally cylindrical and circular in shape. The pintle 96 extends axially and has a lower end 98 extending radially and having a diameter greater than a remainder thereof. The lower end 98 of the pintle 96 is disposed in the guide passageway 40, which guides the axial movement of the pintle 96. The lower end 98 cooperates with the tapered slot 41 to vary a restriction of the insert 38 to form a variable purge orifice. The pintle 96 extends axially through the aperture 90 of the seal and piston 86. The pintle 96 also has a flange 100 extending radially to abut a lower end of the piston 86. The pintle 96 is made of a rigid material such as metal, preferably ferrous or stainless steel. It should be appreciated that the upper end of the pintle 96 is disposed within the end of the spring 94. It should be appreciated that the tapered slot 41 allows fluid, for example purge gas, to flow past the pintle 96.

The regulating device 74 includes a retainer 102 connected to the pintle 96 to retain the pintle 96 to the piston 86. The retainer 102 is generally cylindrical and circular in shape. The retainer 102 has a passageway 104 extending axially therethrough. The retainer 102 is made of a rigid material such as metal. The upper end of the pintle 96 is disposed in the passageway 104 and the retainer 102 is secured thereon by a suitable mechanism such as press-fitting.

The regulating device 74 includes an end plug 106 connected to the retainer 102. The end plug 106 has a head portion 108 extending radially and a shaft portion 110 extending axially from the head portion 108. The shaft portion 110 is partially disposed in the passageway 104 of the retainer 102. The end plug 106 may include at least one, preferably a plurality of washers 112 disposed about the shaft portion 110 between the head portion 108 and the axial end of the retainer 102 to adjust a length of the end plug 106 to act as a stop against the housing 76. The end plug 106 is made of a rigid material such as metal. The end plug 106 is secured to the retainer 102 by a suitable mechanism such as press-fitting.

The variable purge orifice assembly 10 includes a cover 114 disposed over a portion of the housing 76 and the housing 30. The cover 114 is generally cylindrical and circular in shape. The cover 114 has an aperture 116 extending axially therethrough to allow a portion of the housing 76 to extend therethrough. The cover 114 is made of a rigid material such as metal. It should be appreciated that the cover 114 is secured to the housing 30 by a suitable mechanism such as press-fitting.

The variable purge orifice assembly 10 further includes a connector 118 connected to the housing 76 for connection to manifold vacuum. The connector 118 is generally cylindrical and circular in shape. The connector 118 has a flange 120 extending radially outward. The connector 120 is partially disposed in the passageway 80 of the housing 76 such that the flange 120 sits in a recess 121 of the housing 76. The connector 118 has a passageway 122 extending axially therethrough. The connector 118 is made of a rigid material such as metal.

In operation, the variable purge orifice assembly 10 is illustrated in FIG. 2 at a low manifold vacuum state and in FIG. 3 at a high manifold vacuum state. At low manifold vacuum as illustrate in FIG. 2, the purge orifice is maximized due to the lower end 98 of the pintle 96 of the regulating device 74 being farthest axially from the upper end of the tapered slot 41 and flow of the purge solenoid 28 is unrestricted. At high vacuum manifold as illustrate in FIG. 3, the purge orifice is minimized due to the lower end 98 of the pintle 96 of the regulating device 74 being closest axially to the upper end of the tapered slot 41 and flow of the purge solenoid 28 is restricted. It should be appreciated that the restriction allows the flow rate of the purge solenoid 28 to be increased without losing low flow resolution. It should also be appreciated that the flow regulation is achieved by utilizing engine manifold vacuum to actuate the regulating device 74.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A variable purge orifice assembly for an evaporative emission system of a vehicle comprising:

a housing for fluid connection to a vapor canister and a purge solenoid of the evaporative emission system, said housing having a purge orifice therein and a substantially constant diameter guide passageway extending therethrough; and a regulating device connected to said housing and for connection to an engine of the vehicle, said regulating device being actuated by manifold vacuum from the engine to vary flow of fuel vapor through said purge orifice from the vapor canister to the purge solenoid, said regulating device including a movable pintle disposed within said guide passageway, wherein said purge orifice comprises at least one radially tapered slot extending axially through said housing and radially outwardly from said guide passageway, said slot and pintle coacting to define said purge orifice.

2. A variable purge orifice assembly as set forth in claim 1 wherein said regulating device includes a regulator housing with a cavity extending axially therein.

3. A variable purge orifice assembly as set forth in claim 2 wherein said regulating device includes a movable piston disposed in said cavity.

4. A variable purge orifice assembly as set forth in claim 3 wherein said pintle is operatively supported by said piston.

5. A variable purge orifice assembly as set forth in claim 4 wherein said regulating device includes a seal connected to said piston and extending across said cavity to said regulator housing.

6. A variable purge orifice assembly as set forth in claim 5 wherein said regulating device includes a spring disposed in said cavity between said piston and said regulator housing to urge said piston toward a valve seat.

7. A variable purge orifice assembly as set forth in claim 6 wherein said regulating device includes a fluid passageway extending radially into said regulator housing and being located axially between an axial end of said housing and said seal to allow the manifold vacuum to said seal.

8. A variable purge orifice assembly as set forth in claim 6 wherein said regulating device includes a retainer disposed in said cavity and connected to an upper end of said pintle adjacent said piston.

9. A variable purge orifice assembly as set forth in claim 8 wherein said regulating device includes an end plug connected to said retainer to adjust an effective axial height of said retainer.

10. A variable purge orifice assembly as set forth in claim 1 wherein said housing includes a fluid passageway extending radially therein to allow the fuel vapor to flow through a valve seat to said purge orifice.

11. A variable purge orifice assembly as set forth in claim 10 wherein said housing includes a fluid passageway extending axially therein to allow the fuel vapor to flow from said orifice to the purge solenoid.

12. An evaporative emission system of a vehicle comprising:

a vapor canister fluidly communicating with a fuel tank to adsorb fuel vapor;

a purge solenoid fluidly communicating with an engine of the vehicle; and a variable purge orifice assembly fluidly communicating with said vapor canister and said purge solenoid and the engine to vary flow of the fuel vapor from said vapor canister to said purge solenoid in response to being actuated by manifold vacuum from the engine, said variable purge orifice assembly comprising:

a housing for fluid connection to said vapor canister and said purge solenoid, said housing having a purge orifice therein and a substantially constant diameter guide passageway extending therethrough; and a regulating device connected to said housing and for connection to an engine of the vehicle, said regulating device being actuated by manifold vacuum from the engine to vary flow of fuel vapor through said purge orifice from the vapor canister to the purge solenoid, said regulating device including a movable pintle disposed within said guide passageway, wherein said purge orifice comprises at least one radially tapered slot extending axially through said housing and radially outwardly from said guide passageway, said slot and pintle coacting to define said purge orifice.

13. An evaporative emission system as set forth in claim 12 wherein said vapor canister includes a first tube fluidly communicating with the fuel tank and a second tube fluidly communicating with said purge solenoid.

14. An evaporative emission system as set forth in claim 13 wherein said variable purge orifice assembly is fluidly connected to said second tube.

15. An evaporative emission system as set forth in claim 13 wherein said variable purge orifice assembly is located between said vapor canister and said purge solenoid.

16. A vehicle comprising:

an engine;

a fuel tank for supplying fuel to said engine;

a vapor canister fluidly communicating with said fuel tank to adsorb fuel vapor from said fuel tank;

a purge solenoid fluidly communicating with said engine to purge said adsorbed fuel vapor to said engine; and a variable purge orifice assembly fluidly communicating with said vapor canister and said purge solenoid and said engine to vary flow of the fuel vapor from said vapor canister to said purge solenoid in response to being actuated by manifold vacuum from said engine, said variable purge orifice assembly comprising:

a housing for fluid connection to a vapor canister and a purge solenoid of the evaporative emission system, said housing having a purge orifice therein and a substantially constant diameter guide passageway extending therethrough; and a regulating device connected to said housing and for connection to an engine of the vehicle, said regulating device being actuated by manifold vacuum from the engine to vary flow of fuel vapor through said purge orifice from the vapor canister to the purge solenoid, said regulating device including a movable pintle disposed within said guide passageway, wherein said purge orifice comprises a radially tapered slot extending axially through said housing and radially outwardly from said guide passageway, said slot and pintle coacting to define said purge orifice.

17. A variable purge orifice assembly for a vehicle evaporative emission system comprising:

a housing adapted for connection within said system and having a guide passage therein interconnecting inlet and outlet ports;

a vehicle engine vacuum operated regulating device connected to the housing operative to selectively position a pintle within said guide passage, at least one radially tapered slot within said housing extending axially along and communicating with said guide passage, said tapered slot and pintle coacting to define a variable purge orifice.

* * * * *